US005927800A

United States Patent [19]

Stallworth

[11] Patent Number: 5,927,800

[45] Date of Patent: Jul. 27, 1999

[54] THEATER TRASH BAG

[76] Inventor: Marcus Stallworth, P.O. Box 8969, Los Angeles, Calif. 90008

[21] Appl. No.: 08/925,604

[22] Filed: Sep. 8, 1997

[51] Int. Cl.[6] ..... A47C 7/62

[52] U.S. Cl. ..... 297/188.08; 297/188.1; 297/188.12; 383/13; 383/33; 383/111

[58] Field of Search ..... 297/188.08, 188.1, 297/188.04, 188.06, 188.12, 188.13, 188.14; 224/275, 928; 383/11, 13, 33, 111

[56] References Cited

U.S. PATENT DOCUMENTS

| | | | |
|---|---|---|---|
| 2,061,302 | 11/1936 | Figler | 383/33 X |
| 2,078,438 | 4/1937 | Baxter | 383/13 |
| 2,163,759 | 6/1939 | McCann | 297/188.2 |
| 3,763,972 | 10/1973 | Karzmar | 297/188.2 X |
| 4,050,491 | 9/1977 | Hargrove | 150/1.6 |
| 4,262,962 | 4/1981 | Yust | 297/194 |
| 4,332,361 | 6/1982 | McClellan | 248/95 |
| 4,338,979 | 7/1982 | Dow | 141/10 |
| 4,738,478 | 4/1988 | Bean, Jr. | 297/55 |
| 4,810,031 | 3/1989 | Patterson | 297/192 |
| 4,852,941 | 8/1989 | Jones | 297/188 |
| 5,004,295 | 4/1991 | Inoue | 297/191 |
| 5,062,533 | 11/1991 | Fickes et al. | 211/12 |
| 5,160,063 | 11/1992 | Bailey | 220/404 |
| 5,190,345 | 3/1993 | Lin | 297/188.12 |
| 5,226,576 | 7/1993 | Ellsworth | 224/928 X |
| 5,232,118 | 8/1993 | Samuel | 220/404 |
| 5,267,711 | 12/1993 | Perreault | 248/101 |
| 5,356,061 | 10/1994 | Yu | 297/188.2 X |
| 5,359,737 | 11/1994 | Hodge | 4/483 |
| 5,390,976 | 2/1995 | Doughty et al. | 297/115 |
| 5,415,457 | 5/1995 | Kifer | 297/188.04 |
| 5,573,288 | 11/1996 | Raffensperger | 297/188.1 X |

FOREIGN PATENT DOCUMENTS

| | | | |
|---|---|---|---|
| 1171746 | 1/1959 | France | 297/188.13 |

*Primary Examiner*—Peter R. Brown
*Attorney, Agent, or Firm*—Zarley, McKee, Thomte, Voorhees & Sease; Dennis L. Thomte

[57] ABSTRACT

A trash bag for theater seats includes a bag having front and rear panels connected along opposing side edges and the bottom, and a mouth formed by upper edges of the front and rear panels. A pair of cooperable fasteners are connected to the bag with first halves of the fasteners mounted on opposite ends of the mouth and second halves of the fasteners attached to a chair. Elastic strips are mounted along the upper edges of the bag to bias the bag to a closed position when removed from the fasteners on the chair.

12 Claims, 3 Drawing Sheets

THEATER TRASH BAG

TECHNICAL FIELD

The present invention relates generally to trash containers, and more particularly to a trash bag with a removable fastener system for theater seats.

BACKGROUND OF THE INVENTION

One of the most annoying problems associated with movie theaters, auditoriums, stadium and coliseum seating areas, is the trash which is dropped on the floor and subsequently stepped on by those attending the particular event. While movie theaters and stadiums typically provide garbage cans at the end of aisles, such locations are simply not convenient for the typical movie goer. Once a person has consumed the desired amount of food or drink, the remains are not likely to be held until the completion of the movie and thence carried to the end of an aisle for proper disposal. For this reason, all locations have stadium type seating must hire janitorial staff to pick up remaining trash, and clean floors where food and beverage items have spilled. If this occurs between showings of movies, the amount of staff required to properly clean up the auditorium is quite large.

SUMMARY OF THE INVENTION

It is therefore a general object of the present invention to provide an improved trash bag for theater seats.

Another object is to provide a trash bag with a cooperable fastening system which permits quick and easy attachment and removal of individual trash bags from a plurality of seats.

A further object of the present invention is to provide a trash bag for theater seats which is efficiently removed and replaced.

Yet another object is to provide a trash bag for stadium seating with individual trash receptacles for each seat, to reduce clean up costs and time.

These and other objects of the present invention will be apparent to those skilled in the art.

The trash bag for theater seats of the present invention includes a bag having front and rear panels connected along opposing side edges and the bottom, and a mouth formed by upper edges of the front and rear panels. A pair of cooperable fasteners are connected to the bag with first halves of the fasteners mounted on opposite ends of the mouth and second halves of the fasteners attached to a chair. Elastic strips are mounted along the upper edges of the bag to bias the bag to a closed position when removed from the fasteners on the chair. A retainer attached to the chair will hold the mouth of a trash liner in an accessible position, with the remainder of the liner inserted within the bag. The liner may be easily removed and replaced from the bag by disconnecting the liner from the retainer and sliding the liner out of the bag.

DESCRIPTION OF THE PREFERRED EMBODIMENTS

Figure 1:
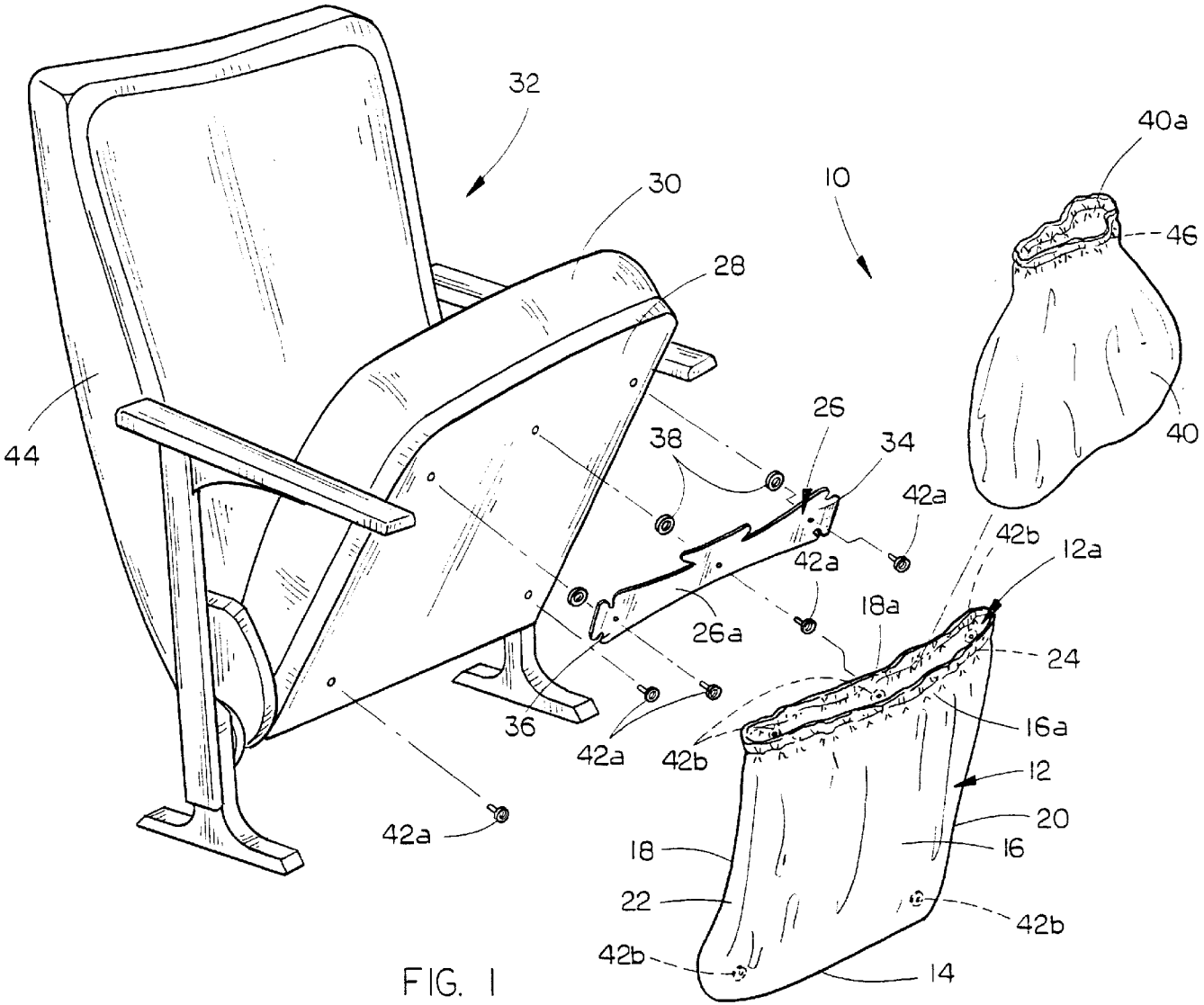
FIG. 1 is a pictorial view of the trash bag of the present invention attached to a theater seat.
Figure 2:
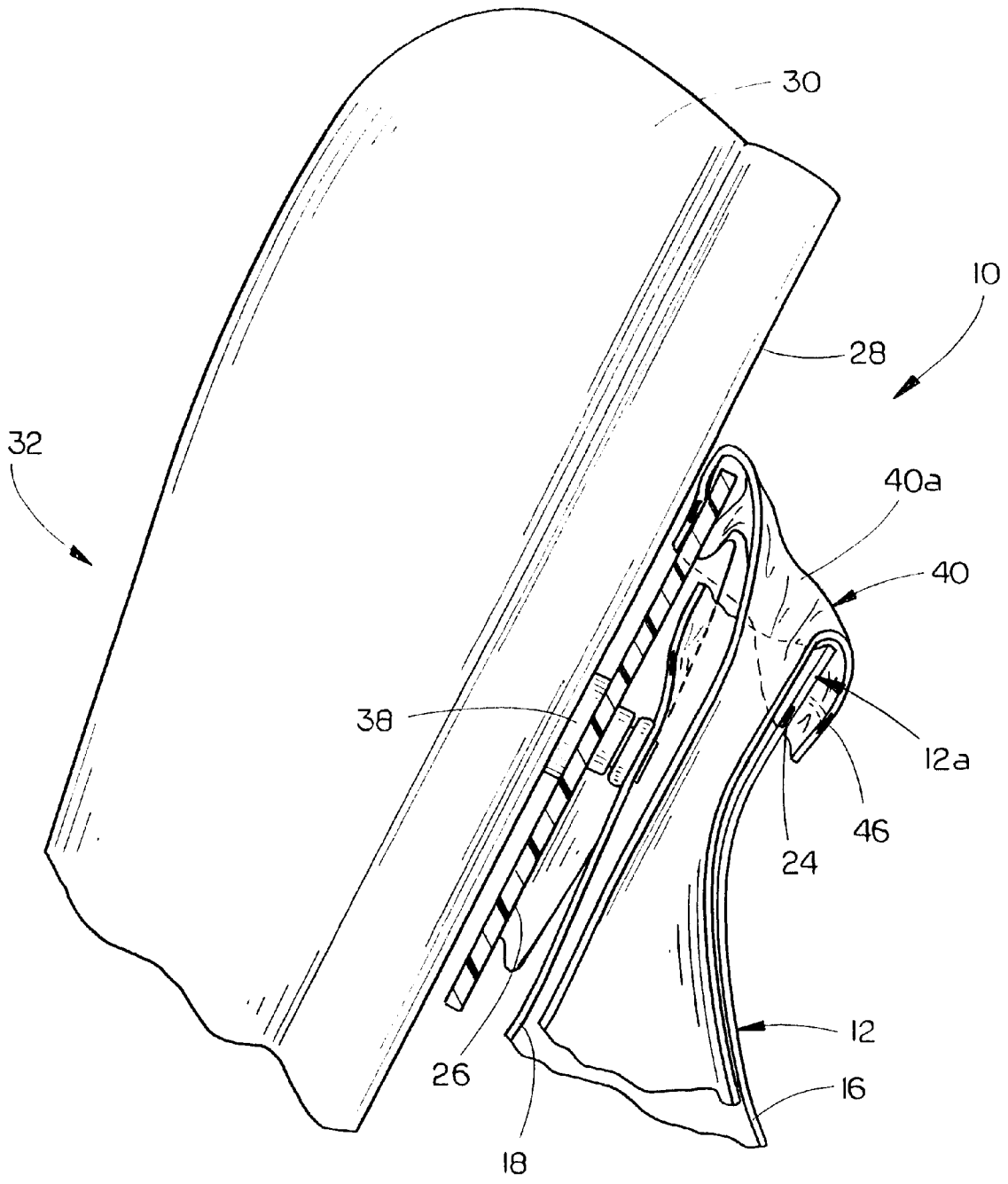
FIG. 2 is an enlarged sectional view of a portion of the trash bag of the present invention installed on a seat.
Figure 3:
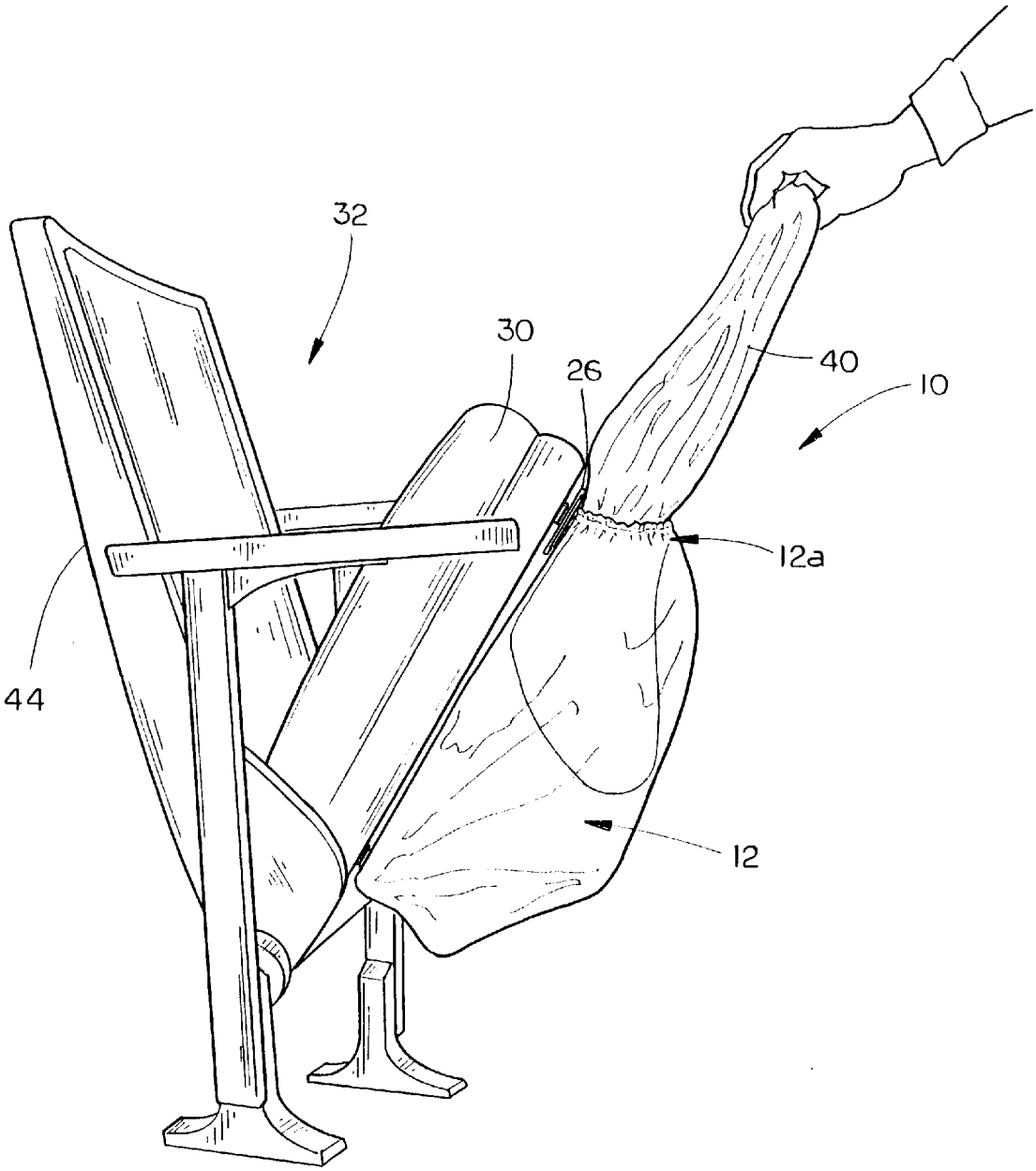
FIG. 3 is a side elevational view of a seat with the trash bag of the present invention connected thereto and the liner being removed.

Referring now to the drawings, in which similar or corresponding parts are identified with the same reference numeral and more particularly to FIG. 1, the trash bag of the present invention is designated generally at 10 and shown in exploded perspective view.

Trash bag 10 includes a bag 12 preferably formed of a plastic or other liquid impervious material. Bag 12 includes a bottom 14, front and rear panels 16 and 18 respectively connected along side edges 20 and 22 and along bottom 14. The upper edges 16*a* and 18*a* of front and rear panels 16 and 18 have an elastic strip 24 attached along the length of their edges, to urge the mouth 12*a* of bag 12 to a substantially closed position.

A retainer plate 26 is mounted to the bottom panel 28 on the seat cushion 30 of a theater seat 32. Retainer plate 26 is an elongated flat plate having enlarged opposing ends 34 and 36. Spacers 38 are mounted between retention plate 26 and bottom panel 28, to space plate 26 slightly away from the bottom panel, and thereby permit the attachment of the mouth 40*a* of a bag-like trash liner 40, as described in more detail hereinbelow.

One-half 42*a* of a cooperable fastener 42 is mounted to the projecting face 26*a* of the retainer plate ends 34 and 36, as well as to the bottom panel 28, spaced below retainer plate 26. A fifth fastener half 42*a* may also be mounted to retainer plate 26 generally midway between ends 34 and 36, for additional support. The corresponding second halves 42*b* of fasteners 42 are mounted to the rear panel 18 of bag 12, at each end of the upper edge 18*a* and adjacent the bottom 14, to correspond with fastener first halves 42*a*. In this way, when fastener second halves 42*b* are attached to fastener first halves 42*a*, elastic strip 24 will be stretched, and will thereby permit the bag mouth 12*a* to easily receive a trash liner 40 therein.

Although fasteners 42 are shown throughout the drawings as a snap-type fastener, with the female portion affixed to the bag and the male portion affixed to the seat bottom, other equivalent fasteners could be used as well. For example, one-half of a hook and loop fastener could be affixed to the bag and the other half to the seat bottom.

In use, retainer plate 26 is first fastened in a generally horizontal orientation to the bottom panel 28 of the seat cushion 30, with fastener first halves 42*a* projecting outwardly. Additional fastener first halves 42*a* are attached to bottom panel 28 spaced downwardly from the retainer plate 26, as shown in the drawings. Although the preferred embodiment of the invention locates the retainer plate 26 and fastener first halves 42*a* on the bottom panel 28, they could be placed on the theater seat backs 44, or other convenient location. Once the retainer plate 26 and additional fastener first halves 42*a* are affixed to the seats, individual bags 12 are connected thereto by connecting the fastener second halves 42*b* of the bag to the fastener first halves 42*a* on the seat. A trash liner may then be easily inserted within each individual trash bag 12 with the trash liner mouth 40*a* projecting out of the bag mouth 12*a*. The enlarged ends of retainer plate 26 will permit the trash liner mouth 40*a* to be rolled outwardly and around the retainer plate ends, to maintain the liner mouth 40*a* in an open condition, for receiving garbage. Trash liner 40 may be of the type having an elastic band 46 attached all around the mouth 40*a*, to further secure the trash liner mouth 40*a* on retainer plate 26, and to draw the mouth closed when removed from retainer plate 46.

Because each theater seat 32 has its own individual trash bag 10, a person may simply and easily dispose of remaining food, beverage, or other garbage into the liner 40 within the removable bag 12, thereby keeping the floor clean. After the patrons have left the theater, it is a simple task for a person to walk down the row of seats removing trash liners 40 and replacing them with fresh empty liners. If necessary, an individual trash bag 12 may also be easily removed and replaced, if damaged.

Whereas the invention has been shown and described in connection with the preferred embodiment thereof, many modifications, substitutions and additions may be made which are within the intended broad scope of the appended claims.

I claim:

1. In combination:

a chair including a back and a seat which is pivotal between an upright inoperative position and a substantially horizontally disposed operative position;

said seat including a bottom surface;

a trash bag having front and rear panels connected together along opposing side edges, a bottom, and a mouth formed by upper edges of the front and rear panels;

an elastic strip attached along the bag front and rear panel upper edges; and a bag support means on said seat bottom surface, said bag support means including at least one protrusion or indentation of size and shape for removably receiving said elastic strip and for maintaining said elastic strip in a stretched condition;

said bag support means further including a member attached to said seat bottom surface and positioned transversely across said opposing side edges for maintaining said bag in a position adjacent said seat bottom surface when said seat is in its said operative position.

2. The combination of claim 1, further comprising a trash liner having an enclosed bottom end and an open mouth, removably inserted within the trash bag with the liner mouth projecting outwardly out of the trash bag mouth.

3. The combination of claim 1, further comprising at least a plurality of cooperable fasteners, the fastener first halves attached to the chair and the fastener second halves attached to the rear panel of the bag.

4. In combination:

a chair;

a trash bag removably attached to the chair;

said bag having front and rear panels connected together along opposing side edges, a bottom, and a mouth formed by upper edges of the front and rear panels; and at least one, cooperable fastener connecting the bag to the chair, including a first half mounted on the bag rear panel and a second half mounted to the chair;

a trash liner, having an enclosed bottom end and an open mouth, removably inserted within the trash bag with the liner mouth projecting outwardly of the trash bag mouth;

and a retainer plate mounted on the chair, said retainer plate having enlarged opposing ends;

said mouth of said trash liner being attached around the retainer plate ends to maintain said mouth of said liner in a slightly open condition for easy access.

5. The combination of claim 4, further comprising at least a plurality of cooperable fasteners, the fastener first halves attached to the chair and the fastener second halves attached to the rear panel of the bag.

6. The combination of claim 5, wherein the chair includes a back and a seat, the seat having a bottom surface, and wherein said fastener second halves are mounted on the seat bottom surface.

7. The combination of claim 6, wherein said fastener second halves are horizontally aligned and spaced apart a distance equal to a distance between the opposing ends of the bag rear panel upper edge.

8. The combination of claim 7, further comprising an elastic strip attached along the bag front and rear panel upper edges, the strip positioned in a stretched condition when the fastener first and second halves are connected together.

9. The combination of claim 8, further comprising an elastic strip attached along the liner mouth and positioned in a stretched condition when the liner mouth is attached around the retainer plate.

10. In combination:

a chair;

a trash bag removably attached to the chair;

said bag having front and rear panels connected together along opposing side edges, a bottom, and a mouth formed by upper edges of the front and rear panels; and a plurality of cooperable fasteners connecting the bag to the chair, each of said fasteners including a first half mounted on the bag rear panel and a second half mounted to the chair;

said chair including a back and a seat, the seat having a bottom surface, said fastener second halves being mounted on the seat bottom surface;

said fastener second halves being horizontally aligned and spaced-apart a distance equal to the distance between the opposing ends of the bag rear panel upper edge;

and an elastic strip attached along the bag front and rear panel upper edges, the elastic strip being positioned in a stretched condition when the fastener first and second halves are connected together.

11. In combination:

a chair;

a trash bag removably attached to the chair;

said bag having front and rear panels connected together along opposing side edges, a bottom, and a mouth formed by upper edges of the front and rear panels;

at least two spaced-apart cooperable fasteners removably connecting the bag to the chair, said fasteners including first halves mounted on the bag rear panel and second halves affixed to the chair; and an elastic strip attached along the bag front and rear panel upper edges, said strip positioned in a stretched condition when the fastener first and second halves are connected together.

12. A method for maintaining cleanliness in an area having a plurality of adjacent chairs aligned in a plurality of rows, each of said chairs including a seat having a bottom surface, comprising the steps of:

connecting an empty bag to each of said bottom surfaces of each of said chairs so that said bags are positioned adjacent to said bottom surfaces;

inserting a trashliner in each of the bags, with a mouth of the liners projecting out of the bags;

after a period of time, removing all trash liners having refuse therein; and inserting an empty liner in each bag from which a trash liner was removed.

* * * * *